US012806679B2

(12) United States Patent
De Sutter

(10) Patent No.: US 12,806,679 B2
(45) Date of Patent: Nov. 24, 2026

(54) PUNCH UNIT FOR PUNCHING HOLES IN A PROFILE WITH HIGH THROUGHPUT AND ITS METHOD

(71) Applicant: SOENEN TECHNOLOGY NV, Roeselare (BE)

(72) Inventor: Luc De Sutter, Roeselare (BE)

( * ) Notice: Subject to any disclaimer, the term of this patent is extended or adjusted under 35 U.S.C. 154(b) by 376 days.

(21) Appl. No.: 18/245,690

(22) PCT Filed: Sep. 21, 2021

(86) PCT No.: PCT/EP2021/075882
§ 371 (c)(1),
(2) Date: Mar. 16, 2023

(87) PCT Pub. No.: WO2022/063750
PCT Pub. Date: Mar. 31, 2022

(65) Prior Publication Data

US 2023/0347404 A1 Nov. 2, 2023

(30) Foreign Application Priority Data

Sep. 22, 2020 (BE) ..... 2020/5648

(51) Int. Cl.
*B21D 28/24* (2006.01)

(52) U.S. Cl.
CPC ..... *B21D 28/243* (2013.01); *B21D 28/246* (2013.01)

(58) Field of Classification Search
CPC .. B21D 28/243; B21D 28/246; B21D 28/002; B21D 53/88; B26D 5/00; B26D 5/08
(Continued)

(56) References Cited

U.S. PATENT DOCUMENTS 3,311,297 A * 3/1967 Williamson ..... B26F 1/04 234/116
2003/0167888 A1* 9/2003 Thomsen ..... B26F 1/3813 83/100

(Continued)

FOREIGN PATENT DOCUMENTS

BE 652615 A 12/1964
DE 157673 A1 12/1982

(Continued)

OTHER PUBLICATIONS

Translation JP 2002273531 A (Year: 2026).*
ISR-WO dated Jan. 4, 2022 for parent application PCT/EP2021/075882.

*Primary Examiner* — Nhat Chieu Q Do
(74) *Attorney, Agent, or Firm* — Vorys, Sater, Seymour and Pease, LLP; Iona N. Kaiser

(57) ABSTRACT

A punch unit and a method for punching holes in a profile with high-throughput. The punch unit comprises a clamp, slideable in a first direction; a first die shoe, comprising at least two punches; a second die shoe; and a transmission shaft, configured for translating a rotational movement to a linear movement and configured for displacing said punches in a stroke direction; wherein the punch unit comprises a selection control for selecting the punches to be displaced by the transmission shaft in the stroke direction. The method comprises clamping a profile in a clamp of the punch unit; displacing the profile in the punch unit by sliding the clamp in a first direction; and punching at least one hole in the profile by the punch unit; wherein one or more punches of the punch unit are selected by the selection control, comprised in the punch unit, for punching said at least one hole.

11 Claims, 6 Drawing Sheets

(58) Field of Classification Search
USPC ..... 83/30
See application file for complete search history.

(56) References Cited

U.S. PATENT DOCUMENTS

| | | | | |
|---|---|---|---|---|
| 2010/0107844 | A1* | 5/2010 | Halden | B26D 7/08 83/628 |
| 2017/0274549 | A1* | 9/2017 | Sculthorpe | B26F 1/14 |

FOREIGN PATENT DOCUMENTS

| | | | | |
|---|---|---|---|---|
| EP | 0183298 | A2 | | 6/1986 |
| JP | S5855135 | A | | 4/1983 |
| JP | 2002273531 | A | * | 9/2002 |
| WO | 2022063750 | A1 | | 3/2022 |

* cited by examiner

PUNCH UNIT FOR PUNCHING HOLES IN A PROFILE WITH HIGH THROUGHPUT AND ITS METHOD

CROSS-REFERENCE TO RELATED APPLICATIONS

This application is a 371 of International Patent Application No. PCT/EP2021/075882 filed on Sep. 21, 2021, which claims the benefit of priority from BE2020/5648 filed on Sep. 22, 2020, the disclosure of each of which is incorporated herein by reference in its entirety.

FIELD OF THE INVENTION

The present invention relates to a punch unit for punching holes in a profile with high-throughput.

In a second aspect, the present invention also relates to a method for punching holes in a profile with high-throughput.

In another aspect, the present invention also relates to a use for punching holes in a web of a U-profile for a truck or trailer chassis.

BACKGROUND

Punch units for punching holes in elongated profiles are known from the state of the art. A punch unit comprises at least a feeding device for displacing the profile through the punch unit. The feeding device is driven by a servomotor through a transmission.

Punch lines are for instance used for producing beams of a truck or trailer chassis. The beams are made from U-profiles. The chassis of the truck or trailer consists mainly of two U-profiles in the longitudinal direction of the truck or trailer. The opening of the U-profiles are facing each other. The U-profiles are connected with several cross-beams. Connections are with bolts or rivets. Holes have to be foreseen in the U-profiles for said connections.

On the truck or trailer chassis, different parts and accessories have to be fixed. Examples of parts and accessories are the engine, wheel units, fuel tank, . . . . During the assembly of the truck or the trailer all these parts and accessories are fixed to the chassis with bolts or rivets. Again holes in the U-profiles are required. In the particular case of a heavy truck, often a reinforcement U-profile is inserted inside the beams and has to be connected to said beams with bolts and rivets.

Many holes are to be punched in the U-profiles. These holes can have different diameters. The number of holes in a U-profile for a truck or trailer can vary between 150 and 900. In some cases all these holes are positioned in the web of the U-profiles in a regular pattern or semi-regular pattern.

For a high-throughput in producing profiles it is essential to be able to punch holes at high pace. A punch unit according to the state of the art is not suited for high-throughput punching holes in a profile. A punch unit according to the state of the art has a fixed mechanical construction, making the punch unit unsuited for punching holes in a semi-regular pattern in which diameter and position of the holes can vary along the profile.

Additionally, U-profiles do have tolerances. The width of the U-profile can vary from the specified width. The U-profiles are not necessarily perfectly straight. The U-profiles can have camber. To avoid distortions in the chassis of the truck or trailer and for easy assembly, it is required that the hole positions should follow the camber. This cannot be controlled with a punch unit according to the state of the art.

Known punch units are described in BE 652 615, DD 157 673, EP 0 183 298 and JP S58 55135.

The present invention aims to resolve at least some of the problems and disadvantages mentioned above.

SUMMARY OF THE INVENTION

The present invention and embodiments thereof serve to provide a solution to one or more of above-mentioned disadvantages. To this end, the present invention relates to a punch unit for punching holes in a profile with high-throughput according to claim 1.

The punch unit comprises a clamp, slideable in a first direction, a first die shoe, comprising at least two punches, a second die shoe and a transmission shaft. The transmission shaft is configured for translating a rotational movement to a linear movement and configured for displacing said punches in a stroke direction, transverse to said first direction. The punch unit comprises a selection control for selecting punches to be displaced by the transmission shaft in the stroke direction. This is beneficial because it allows for punching holes at a high pace. The selection control can select multiple punches to punch multiple holes simultaneously, what results in a high-throughput. The selection control can select different punches with every stroke, allowing punching holes in a semi-regular pattern, wherein the diameter and position of the holes can vary along the profile.

The punch unit comprises means for displacing a profile in a direction transverse to the first direction. When a profile has camber, the profile can be repositioned before punching one or more holes, such that the holes are following the camber and are correctly positioned. This is beneficial to avoid distortions in the chassis of the truck or trailer and to allow easy assembly.

More particular, the method as described herein provides that a profile is clamped in a clamp of a punch unit, displaced in the punch unit by sliding the clamp in a first direction, and punching at least one hole in the profile by the punch unit, wherein one or more punches of the punch unit are selected by a selection control, comprised in the punch unit, for punching said at least one hole. This is beneficial because the method allows for punching holes in a profile with high-throughput, while the holes are positioned in a regular or semi-regular pattern, wherein the diameter and the position of the holes can vary along the profile.

The use as described herein provides an advantageous effect that holes can be punched with a high throughput in the web of a U-profile of a truck or trailer chassis, even when the U-profile has camber.

DESCRIPTION OF FIGURES

Each of FIGS. 1A and 1B shows a schematic overview of a punch unit according to an embodiment of the present invention.

DETAILED DESCRIPTION OF THE INVENTION

Figure 1A:
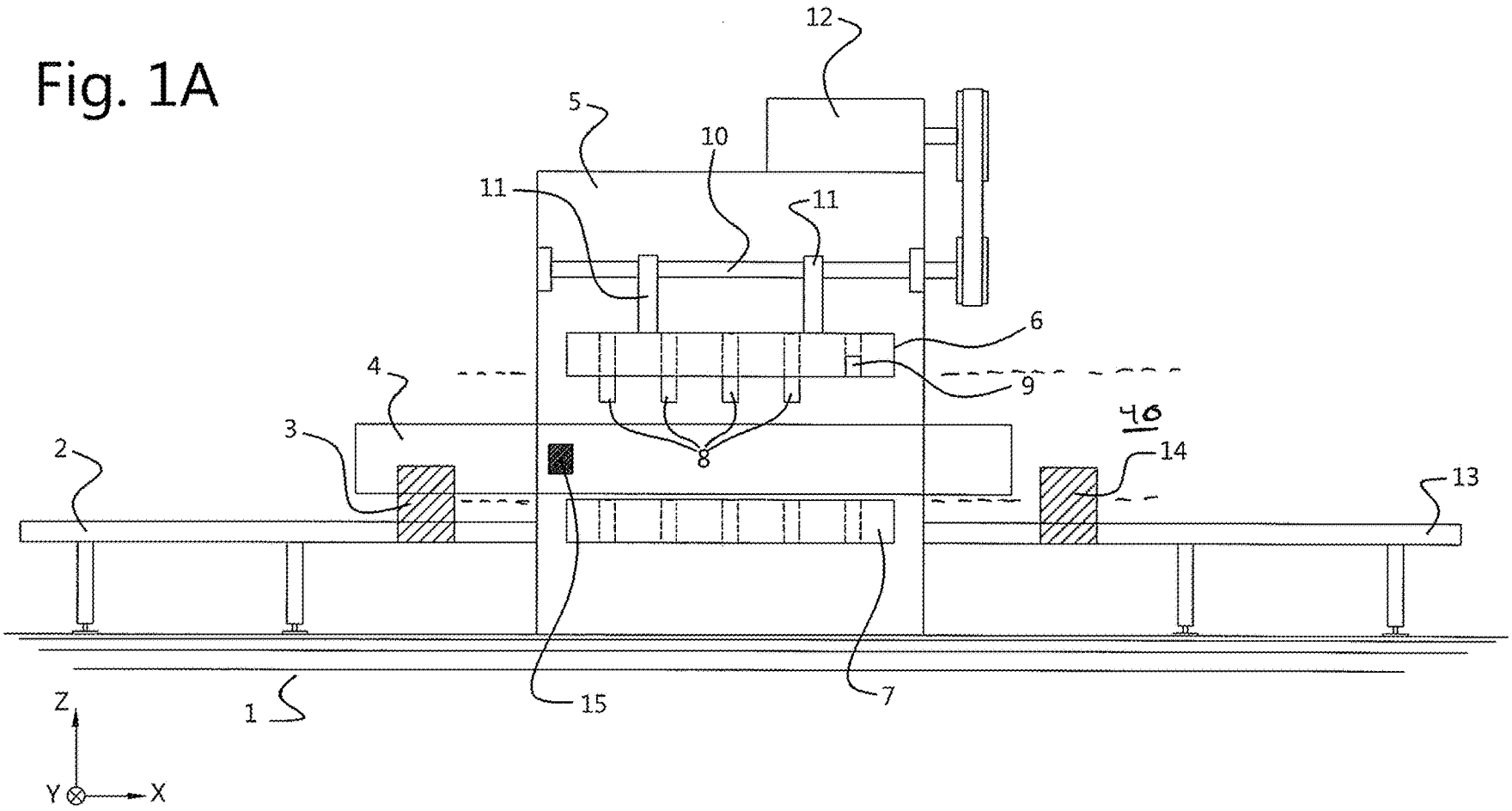

Unless otherwise defined, all terms used in disclosing the invention, including technical and scientific terms, have the meaning as commonly understood by one of ordinary skill in the art to which this invention belongs. By means of further guidance, term definitions are included to better appreciate the teaching of the present invention.

As used herein, the following terms have the following meanings:

"A", "an", and "the" as used herein refers to both singular and plural referents unless the context clearly dictates otherwise. By way of example, "a compartment" refers to one or more than one compartment.

"Comprise", "comprising", and "comprises" and "comprised of" as used herein are synonymous with "include", "including", "includes" or "contain", "containing", "contains" and are inclusive or open-ended terms that specifies the presence of what follows e.g. component and do not exclude or preclude the presence of additional, non-recited components, features, element, members, steps, known in the art or disclosed therein.

Furthermore, the terms first, second, third and the like in the description and in the claims, are used for distinguishing between similar elements and not necessarily for describing a sequential or chronological order, unless specified. It is to be understood that the terms so used are interchangeable under appropriate circumstances and that the embodiments of the invention described herein are capable of operation in other sequences than described or illustrated herein.

The recitation of numerical ranges by endpoints includes all numbers and fractions subsumed within that range, as well as the recited endpoints.

Whereas the terms "one or more" or "at least one", such as one or more or at least one member(s) of a group of members, is clear per se, by means of further exemplification, the term encompasses inter alia a reference to any one of said members, or to any two or more of said members, such as, e.g., any ≥3, ≥4, ≥5, ≥6 or ≥7 etc. of said members, and up to all said members.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to a person skilled in the art from this disclosure, in one or more embodiments. Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the context of this document a profile extends into a longitudinal direction. A profile has a transverse cross-section, mostly invariant between its two end portions. A profile comprises a base. The base is a central substantially flat surface of the profile. Generally the base is the biggest surface of the profile. The profile can comprise additional walls at sides of the base or on the surface of the base.

In the context of this document a U-profile is a profile with a cross-section in the shape of a letter U. The U-profile comprises a base, called web, and at each side of the base a side wall, called flange. The flanges are substantially perpendicular to the base. The flanges of the U-profile extend in the same direction.

In the context of this document a L-profile is a profile with a cross-section in the shape of a letter L. The L-profile comprises a first wall and a second wall, perpendicular to each other. The wall having the biggest surface is the base of the profile.

In the context of this document, camber is a deviation wherein the profile is not perfectly straight, but bends along the longitudinal direction in a plane formed by the base of the profile. In case of a U-profile the base is the web, so the profile bends in a plane defined by the web.

In the context of this document, bow is a deviation wherein the profile is not perfectly straight, but bends along the longitudinal direction in a plane, perpendicular to the plane formed by the base side of the profile. In case of a U-profile the base is the web, so the profile bends in a plane perpendicular to the web.

In the context of this document, throughput is expressed in the number of holes per minute that can be punched in a profile.

In a first aspect, the invention relates to a punch unit for punching holes in a profile with high-throughput.

In a preferred embodiment the punch unit comprises a clamp, a first die shoe, a second die shoe and a transmission shaft. The punch unit is placed on a floor surface. The punch unit comprises a support structure. The clamp of the punch unit is positioned on the support structure. The support structure comprises a longitudinal axis, wherein said longitudinal axis is substantially parallel with the floor surface. This longitudinal axis will be denoted as X-axis in the context of this document. An axis perpendicular to the X-axis and parallel with the floor surface will be denoted as Y-axis and an axis perpendicular to the plane formed by the X-axis and Y-Axis will be denoted with Z-axis in the context of this document. The support structure comprises a first and a second end. The first die shoe and second die shoe are positioned at the second end of the support structure. The first die shoe comprises at least two punches. The second die shoe comprises complementary holes for said at least two punches. The punch unit comprises a passage for profiles in between punches attached to the first die shoe and the second die shoe. The clamp of the punch unit is slideable in a first direction. This first direction corresponds with the direction of the X-axis. The clamp is configured for displacing the profile along the X-axis in the punch unit, wherein the profile extends into a longitudinal direction and wherein said longitudinal direction is parallel with the X-axis. This enables the system to punch holes in the profile at different positions along said profile.

The punch unit comprises a selection control (42, shown in FIG. 1B) for selecting punches to be displaced by the transmission shaft in the stroke direction. The transmission shaft is configured for translating a rotational movement to a linear movement and configured for displacing selected punches in a stroke direction, transverse to the first direction. A selected punch is displaced by the transmission shaft by displacing the first die shoe comprising the selected punches. The first die shoe is displaced from a first position in which selected punches are at a distance of the second die shoe to a second position. In the second position selected punches are positioned at least partly in a complementary hole in the second die shoe. Selected punches punch holes in a profile positioned in the passage by displacing the first die shoe from the first to the second position. Non-selected punches do not punch the profile.

Preferably the stroke direction corresponds with the Y-axis or the Z-axis. Most preferably the stroke direction corresponds with the Z-axis. When the stroke direction corresponds to the Z-axis, the first die shoe and said punches are preferably positioned at an upper side of the passage and the second die shoe at an opposite lower side of the passage. The first die shoe is in this case also called upper die shoe and the second die shoe lower die shoe. This positioning is advantageous for automatically removing material punched out the profile by the punch unit by means of gravity.

The transmission shaft is configured for translating a rotational movement to a linear movement and configured for displacing the first die shoe over a stroke length. The stroke length is the distance travelled by the first die shoe along the stroke direction from the first position to the second position.

The selection control is suited to select multiple punches. The selection control is able to select different punches with every stroke. The selection control is beneficial because it allows for punching holes at a high pace. The selection control can select multiple punches to punch multiple holes simultaneously, what results in a high throughput. The selection control can select different punches with every stroke, allowing punching holes in a semi-regular pattern, wherein the diameter and position of the holes can vary along the profile in the first direction. Whenever the pattern of the holes change, other punches can be selected by the selection control to adapt the pattern punched by the punch unit to correspond with the required semi-regular pattern.

In an embodiment the first die shoe comprises at least three punches, preferably at least four punches, more preferably at least five punches and even more preferably six punches. The first die shoe comprises at most twenty-four punches, preferably at most twenty-three punches, more preferably at most twenty-two punches and even more preferably at most twenty-one punches. A punch unit with a punch force of 250 ton can punch simultaneously five holes in a profile with a thickness of 12 mm. The first die shoe of a punch unit should comprise at least three punches to benefit the most of the ability to punch holes simultaneously with such a punch unit in order to increase throughput. A first die shoe comprising more than twenty-four punches becomes too big for integration in a punch unit. A system with multiple punch units becomes in that case a good alternative.

In an embodiment the punch unit has a punch force of at least 100 ton, preferably at least 150 ton, more preferably at least 200 ton and even more preferably at least 250 ton. A punch force within this range is beneficial for punching simultaneously multiple holes. A person of ordinary skill in the art will appreciate that the higher the punch force, the more holes can be punched simultaneously. A person of ordinary skill in the art will also appreciate that the number of holes that can be punched simultaneously is depending on the thickness of the profile and the shear strength of the material. For instance a punch unit with a punch force of 250 ton can punch simultaneously five holes in a profile with a thickness of 12 mm.

In an embodiment the transmission shaft is a camshaft. The camshaft comprises a pointed cam for displacing punches of the first die shoe. A camshaft is known to a person of ordinary skill in the art. The camshaft translates a rotational movement of the camshaft to a translational displacement in the stroke direction of the first die shoe. When the pointed cam touches the first die shoe, the first die shoe starts displacing from a first position to a second position. The pointed cam is at that moment pointing at an angle $\beta_1$. The second position is reached when the pointed cam is positioned perpendicular on the first die shoe. The pointed cam is at that moment pointing at an angle $\beta_2$. When the camshaft continues the rotational movement, the first die shoe displaces back from the second position to the first position. When the pointed cam stops touching the first die surface, the first die surface remains stationary. The pointed cam is at that moment pointing at an angle $\beta_3$. The angles $\beta$ are referred to an axis through the center of the camshaft, perpendicular to the camshaft and parallel to the floor surface and in the direction of the rotation of the camshaft. During a rotation of 360° the pointed cam displaces the first die shoe once from the first position to the second position and back. The angle from $\beta_1$ to $\beta_3$ is the displacement angle. A camshaft is advantageous for an accurate timed displacement of the first die shoe. Additionally a camshaft is advantageous for transferring a big punch force to the first die shoe. A big punch force can be transferred faster with a camshaft compared to a first die shoe that is displaced with a hydraulic piston.

In an embodiment the transmission shaft is a crankshaft. The crankshaft comprises a crank and a connecting rod for displacing punches of the first die shoe. The connecting rod connects the crank with the first die shoe. A crankshaft is known to a person of ordinary skill in the art. The crankshaft translates a rotational movement of the crankshaft to a translational displacement in the stroke direction of the first die shoe. The first die shoe moves from a first position to a second position. The first and second position are at opposite sides of the profile. The speed of the translational displacement of the first die shoe is zero in the first and second position. When the first die shoe touches the profile, the crank is at an angle $\beta_1$. The second position is reached when the crank is positioned perpendicular on the first die shoe. The crank is at that moment pointing at an angle $\beta_2$. When the crankshaft continues the rotational movement, the first die shoe displaces back from the second position to the first position. When the first die shoe stops touching the profile, the crank is at an angle $\beta_3$. The angles $\beta$ are referred to an axis through the center of the crankshaft, perpendicular to the crankshaft and parallel to the floor surface and in the direction of the rotation of the crankshaft. During a rotation of 360° the crank displaces the first die shoe once from the first position to the second position and back. The angle from $\beta_1$ to $\beta_3$ is the actuation angle. A crankshaft is advantageous for transferring a big punch force to the first die shoe. A big punch force can be transferred faster with a crankshaft compared to a first die shoe that is displaced with a hydraulic piston.

In an embodiment the transmission shaft is configured to rotate at a constant speed. The transmission shaft rotates at a speed of at least 90 rpm, preferably at least 100 rpm, more preferably at least 110 rpm and even more preferably 115 rpm. The transmission shaft rotates at a speed of at most 210 rpm, preferably at most 200 rpm, more preferably at most 190 rpm and even more preferably at most 185 rpm. Within this range it is possible to punch at a fast pace holes in a profile. For instance at 180 rpm and when punching 5 holes simultaneously, 900 holes per minute can be punched in a profile. A constant speed is also advantageous for having a predictable timing for displacing a profile in the first direction. A constant speed is additionally advantageous for displacing in an energy efficient way the first die shoe from a first position to a second position and back, because energy is only required to maintain the rotation of the transmission shaft.

In an embodiment the transmission shaft comprises a flywheel. The flywheel is beneficial to help maintaining the rotational movement of the transmission shaft. In an embodiment the transmission shaft is driven by an electromotor. The electromotor is preferably connected to a 3x 400V 50 Hz power supply for installation in Europe, a 3x 380V 50 Hz power supply for installation in China and a 3x 460V 60 Hz power supply for installation in the USA. The electromotor has a power of at least 70 kW, preferably at least 80 kW, more preferably at least 90 kW and even more preferably at least 100 kW. The required power is depending on punch force, thickness of a profile and rotation speed of the transmission shaft.

In an embodiment the punch unit comprises a plate holder, configured for holding the profile fixed against the second die shoe. The plate holder is displaceable in the stroke direction. The plate holder is pushing the profile against the second die shoe during punching a hole. This is beneficial to avoid that the profile moves during punching a hole, resulting in inaccurate hole position or unequally formed holes. The plate holder releases the profile after punching a hole.

In an embodiment the clamp is configured to displace a profile during regular intervals. Displacing the clamp during regular intervals is beneficial for easy predictable timing for punching holes in the profile. This is especially beneficial in combination with a constant speed of the transmission shaft as described in a previous embodiment of the current invention. The profile is displaced in a time interval wherein the profile is not hold fixed against the second die shoe by the plate holder and/or wherein a selected punch is not in contact with the profile.

In a further embodiment the clamp is configured to displace a profile at soonest when the cam of the camshaft is at angle $\beta_3$ and at latest when the cam of the camshaft is at angle $\beta_1$, preferably at soonest at angle $\beta_3-1°$ and at latest at angle $\beta_1+1°$, more preferably at soonest at angle $\beta_3-2°$ and at latest at angle $\beta_1+2°$, even more preferably at soonest at angle $\beta_3-3°$ and at latest at angle $\beta_1+3°$, and most preferably at soonest at angle $\beta_3-5°$ and at latest at angle $\beta_1+5°$. Because in the case of a camshaft the first die shoe starts displacing from the first position at angle $\beta_1$ and returns to the first position at angle $\beta_3$, the profile is displaced in a time interval wherein a selected punch is not in contact with the profile. Because in the case of a camshaft in the first position a punch is at a distance of the second die shoe and the profile, a bigger time interval from angle $\beta_3-5°$ to angle $\beta_1+5°$ is available for displacing the profile by the clamp, depending on the thickness of the profile and the geometry of the pointed cam of the camshaft.

In a further embodiment the clamp is configured to displace a profile over a constant distance in the first direction during each regular interval. The constant distance is at least 30 mm, preferably at least 35 mm, more preferably at least 40 mm and even more preferably at least 45 mm. The constant distance is at most 70 mm, preferably at most 65 mm, more preferably at most 60 mm and even more preferably at most 55 mm. A constant distance is beneficial to simplify control of the punch unit. A distance within the presented range allows for profiles with a dense regular or semi-regular pattern of holes.

In an embodiment the selection control is configured to select punches during regular intervals. These regular intervals are preferably the same regular intervals for displacing the profile by the clamp as described in previous embodiments of the current invention. This is advantageous for easy predictable timing for punching holes in the profile. It is additionally advantageous to avoid that punches are being selected and unselected during punching holes. This could result in a deformation of a profile at the position of a punch that gets selected or unselected during punching instead of punching a hole.

In an embodiment the punch unit comprises two clamps, slideable in the first direction. The first and second die shoe of the punch unit are positioned in between said two clamps according to the first direction. Said two clamps are similar as the clamp described in a previous embodiment of the invention. Support structures of said two clamps are aligned along their longitudinal axes in the first direction. A first clamp is configured for displacing the profile along the X-axis in the punch unit, wherein the profile extends into a longitudinal direction and wherein said longitudinal direction is parallel with the X-axis. A second clamp is configured for displacing the profile along the X-axis out the punch unit.

The current embodiment is advantageous for creating a continuous punch unit, wherein profiles are fed by the first clamp and removed by the second clamp. The embodiment is also advantageous when it is required to punch holes over substantially the whole length of the profile. In that case it is not possible to clamp the profile with the first clamp on a position not requiring punching holes. By taking over the profile with the second clamp, the first clamp can be released and holes can be punched in the profile on the position previously covered by the first clamp.

In an embodiment the selection control is configured to select one to at least two punches simultaneously, preferably one to at least three punches, more preferably one to at least four punches, and even more preferably one to at least five punches.

In a further embodiment the selection control is configured to select zero or more punches simultaneously. Zero punches are beneficial when no holes may be punched during the displacement angle or actuation angle.

In an embodiment the selection control (42) comprises a locking mechanism, configured for locking a selected punch to the first die shoe. Preferably the locking mechanism can lock every punch individually. The locking mechanism firmly fixates a punch to the first die shoe. A selected and locked punch is displaced together with the first die shoe from the first to the second position and punches a hole in the profile. A non-selected and consequently not-locked punch is not fixated to the first die shoe and is not displaced together with the first die shoe from the first to the second position. Alternatively, a non-selected punch is displaced together with the first die shoe and is in a retracted position in the first die shoe so that said non-selected punch does not touch the profile and does not punch a hole in the profile.

In a further embodiment the locking mechanism comprises a mechanical lock (44) and an electromechanical steering, configured for driving the mechanical lock inside a selected punch or to clamp the mechanical lock around the selected punch.

In an alternative embodiment the locking mechanism comprises a mechanical lock (44) and a hydraulic steering, configured for driving the mechanical lock inside a selected punch or to clamp the mechanical lock around the selected punch.

In an alternative embodiment the locking mechanism comprises a mechanical lock (44) and a pneumatic steering, configured for driving the mechanical lock inside a selected punch or to clamp the mechanical lock around the selected punch. FIG. 1B conceptually represents a locking mechanism comprising a mechanical lock (44) including an electromechanical steering, a hydraulic steering, or a pneumatic steering.

In an embodiment the first die shoe comprises at least two punches positioned in the first die shoe on a line perpendicular to both the first direction and the stroke direction. Preferably said at least two punches are positioned on a line parallel with the Y-axis or the Z-axis, most preferably parallel with the Y-axis. Preferably the first die shoe comprises at least three punches positioned in the first die shoe on a line perpendicular to both the first direction and the stroke direction, more preferably at least four punches and even more preferably at least five punches. This is advantageous for punching holes in profiles wherein a profile comprises parallel tracks of holes in the first direction and wherein the holes on the different parallel tracks are positioned at a same position in the first direction. Five parallel tracks are sufficient for most common profiles with regular and semi-regular hole patterns.

In an embodiment the punch unit comprises means for displacing a profile in a direction transverse to the first direction. Preferably said direction is parallel with the Y-axis or the Z-axis, most preferably parallel with the Y-axis. This is advantageous for punching holes accurately in a profile with camber or bow. When having for instance camber, the holes would be accurately positioned in the first direction, corresponding with the direction of the X-axis, by displacing the clamp of the punch unit, but not in a direction transverse to the first direction. For instance, in case of a U-profile, whereby the web of the U-profile is in a plane parallel to the plane formed by the X-axis and Y-axis, holes in the web of the U-profile would not be accurately positioned in the direction of the Y-axis when having camber. By displacing the profile in the direction of the Y-axis using said means for displacing a profile, corrective actions are taken and an accurate position of holes in said direction transverse to the first direction, Y-axis in this example, can be obtained.

In a further embodiment the clamp of the punch unit is slideable in a direction transverse to the first direction. The clamp is slideable in the first direction and in a direction transvers to the first direction. The clamp is suited as for displacing a profile in a direction transverse to the first direction.

In an embodiment a punch unit comprises a displacement sensor, configured for measuring displacement of the profile in a direction transverse to the first direction. This is advantageous for punching holes accurately in a profile with camber or bow. This is especially advantageous in combination with means for displacing a profile in a direction transverse to the first direction as described in a previous embodiment of the current invention. Because the displacement of the profile in said direction transverse to the first direction can be measured with the displacement sensor, corrective actions can be taken automatically by displacing the profile in a direction transverse to the first direction by using said means and an accurate position of holes in said direction transverse to the first direction can be obtained. The displacement sensor is positioned at the passage for the profile. This is advantageous because the displacement sensor measures the displacement of the profile in said direction transverse to the first direction close to the position according the first direction where the holes have to be punched. This results in small measurement errors and accurate positioning of the holes in said direction transverse to the first direction.

In a further embodiment the displacement sensor comprises a measuring pin or measuring roll. The measuring pin or measuring roll is coupled to a linear encoder. The linear encoder is configured to measure a linear displacement of the measuring pin or measuring roll. The linear encoder has a minimal measurement accuracy in said direction transverse to the first direction of ±0.04 mm, preferably ±0.03 mm, more preferably ±0.02 mm and even more preferably ±0.01 mm. The linear encoder has a measuring range from 0 mm to at least 200 mm, preferably at least 300 mm, more preferably at least 400 mm, even more preferably at least 500 mm. Preferably the linear encoder has a measuring range from 0 mm to at least equal to a maximum difference between positions of flanges of different profiles to be punched by the punch unit. The measuring range is defined as the distance between a lowest and highest possible output of the linear encoder.

In a further embodiment the displacement sensor comprises two measuring pins or measuring rolls, wherein the two measuring pins or measuring rolls are positioned at opposite sides of the passage for the profile. Two measuring pins or measuring rolls at opposite sides of a passage for the profile is especially advantageous when different holes to be punched in the profile are referenced from different sides of the profile. For instance in case of a U-profile, whereby the web of the U-profile is in a plane parallel to the plane formed by the X-axis and Y-axis, a first hole in the web can be referenced along the Y-axis starting from a first flange and a second hole in the web starting from a second flange.

In an embodiment the displacement sensor comprises servomotors for pushing the measuring pins or measuring rolls against the profile.

In an embodiment the displacement sensor comprises springs for pushing the measuring pins or measuring rolls against the profile. In this embodiment a measuring roll is preferred, because a measuring pin could potentially damage a profile when it is displaced by the clamp in the first direction.

In a preferred embodiment the displacement sensor comprises pneumatic cylinders for pushing the measuring pins or measuring rolls against the profile. In this embodiment a measuring roll is preferred, because a measuring pin could potentially damage a profile when it is displaced by the clamp in the first direction.

Figure 5A:
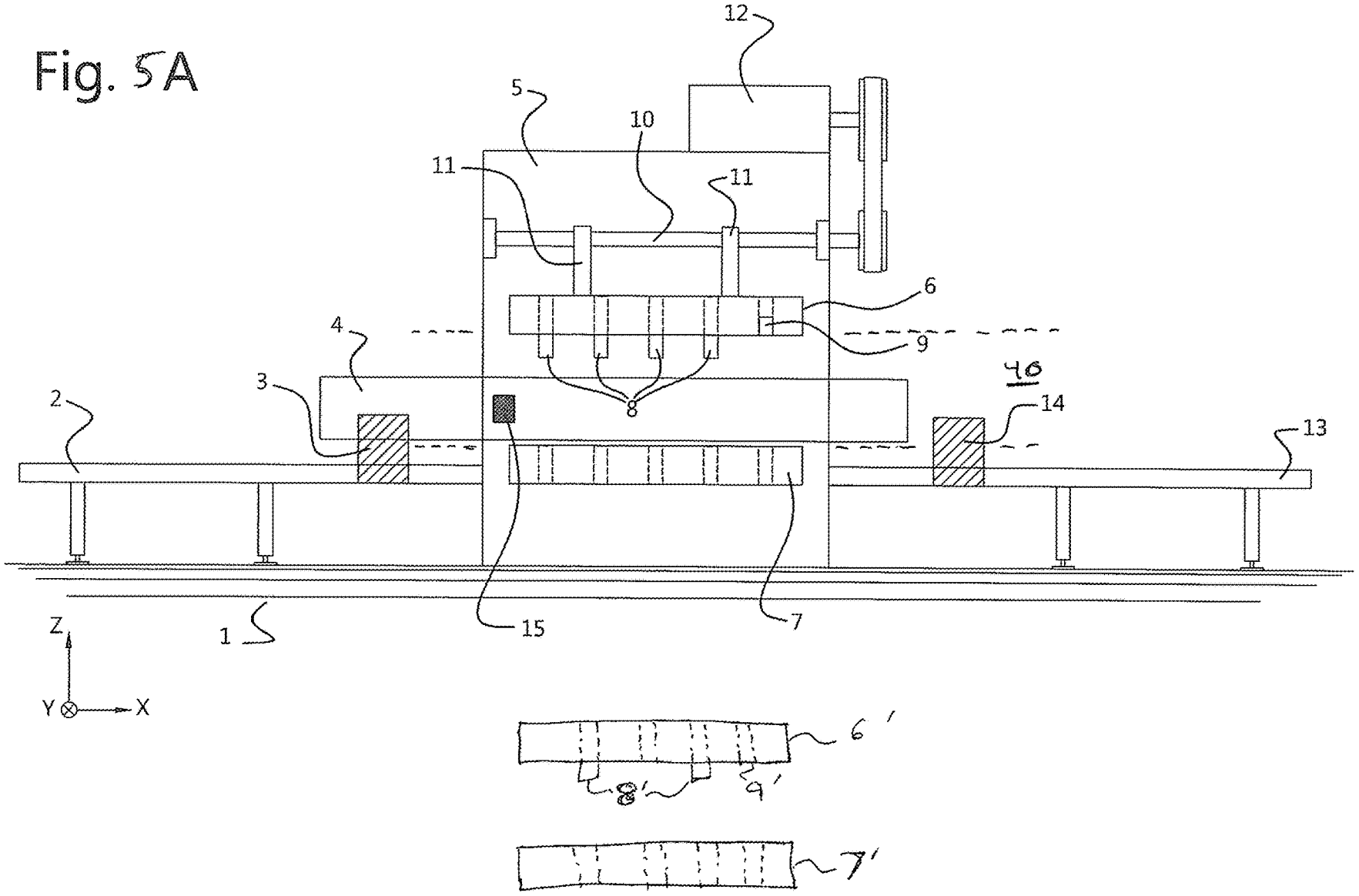
FIG. 5A shows a schematic overview of a punch unit system wherein the punch unit comprises an installed first die shoe (6), second die shoe (7) and punches (8, 9), wherein the system further comprises a suited first die shoe (6'), second die shoe (7') and corresponding punches (8', 9').
Figure 5B:
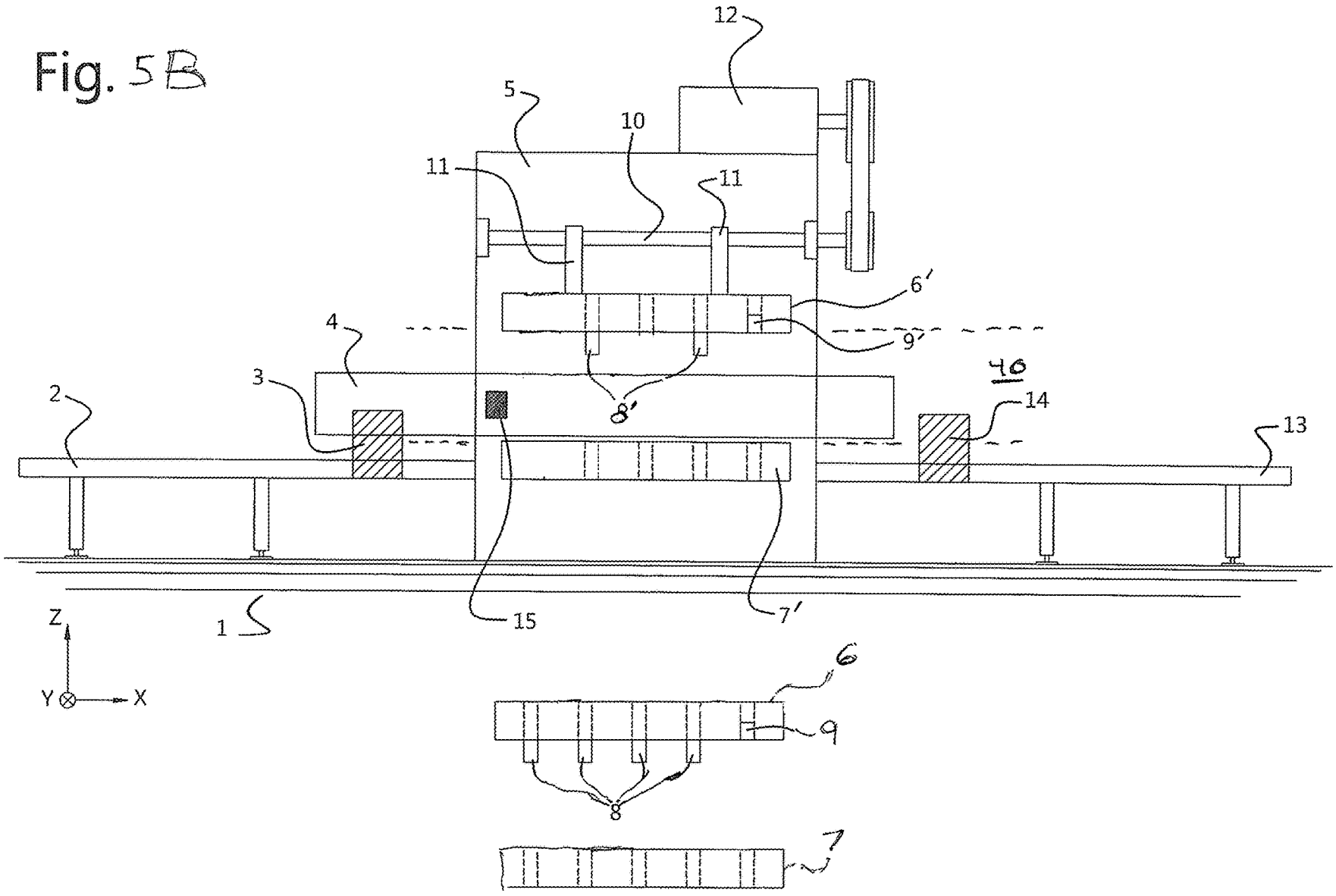
FIG. 5B shows a schematic overview of a punch unit system wherein the punch unit comprises a suited first die shoe (6'), second die shoe (7') and corresponding punches (8', 9'), after exchange of first die shoe (6), second die shoe (7) and punches (8, 9).

In an embodiment as depicted in FIG. 5A and FIG. 5B, the first die shoe (6), the punches (8, 9) and the second die shoe (7) are replaceable. This is especially advantageous when a profile has to be processed that comprises a semi-regular pattern of holes that cannot be obtained with an installed first die shoe and second die shoe and the corresponding punches. By replacing the installed first die shoe (6), second die shoe (7) and punches (8, 9) with a suited first die shoe (6'), second die shoe (7') and corresponding punches (8', 9'), the profile can be processed by the punch unit and the semi-regular pattern of holes can be obtained.

In a second aspect, the invention relates to a method for punching of holes in a profile with high-throughput.

In a preferred embodiment, the method comprises the steps of clamping a profile in a clamp of a punch unit, displacing the profile by sliding the clamp in a first direction in the punch unit and punching at least one hole in the profile by the punch unit. The punch unit comprises a clamp, a first die shoe, a second die shoe and a transmission shaft. The clamp of the punch unit is positioned on a support structure. The support structure comprises a longitudinal axis, wherein said longitudinal axis is substantially parallel with the floor surface. The direction of the longitudinal axis corresponds with the first direction. The first die shoe comprises at least two punches. The second die shoe comprises complementary holes for said at least two punches. The punch unit comprises a passage for profiles in between punches attached to the first die shoe and the second die shoe. The punch unit comprises a selection control for selecting punches to be displaced by the transmission shaft in the stroke direction. The transmission shaft is configured for translating a rotational movement to a linear movement and configured for displacing selected punches in a stroke direction, transverse to the first direction. A selected punch is displaced by the transmission shaft by displacing the first die shoe comprising the selected punches. The first die shoe is displaced from a first position in which selected punches are at a distance of the second die shoe to a second position. In the second position selected punches are positioned at least partly in a complementary hole in the second die shoe. Selected punches punch holes in a profile positioned in the passage by displacing the first die shoe from the first to the second position. Non-selected punches do not punch the profile. One or more punches of the punch unit are selected by the selection control for punching said at least one hole. It is clear for a person of ordinary skill in the art when multiple punches are selected, multiple holes will be punched simultaneously. Preferably punches are selected automatically by the selection control with every stroke.

The method is advantageous because the method allows for punching simultaneously multiple holes in a profile at high pace, wherein the holes are positioned in a regular or semi-regular pattern, and wherein the diameter and the position of the holes can vary along the profile in the first direction. Whenever the pattern of the holes change, other punches can be selected by the selection control to adapt the pattern punched by the punch unit to correspond with the required semi-regular pattern.

In an embodiment the clamp of the punch unit remains at least stationary while a punch of the punch unit is in contact with the profile. When a punch is in contact with the profile, the hole is in progress of being punched. If the clamp is at that moment not stationary, the position of the hole in the first direction will be inaccurate. The form of the hole will also be irregular and unequal. The displacement of the clamp during punching will introduce stress in the punch, leading to excessive wear and/or breakage of the punch and the first and second die shoe. Consequently it is beneficial that the clamp of the punch unit remains stationary during punching. Preferably the clamp of the punch unit displaces the profile during regular intervals. This is advantageous for easy predictable timing for punching holes in the profile. In an embodiment the clamp displaces the profile over a constant distance in the first direction between every stroke of the punch unit. The constant distance is at least 30 mm, preferably at least 35 mm, more preferably at least 40 mm and even more preferably at least 45 mm. The constant distance is at most 70 mm, preferably at most 65 mm, more preferably at most 60 mm and even more preferably at most 55 mm. A constant distance is beneficial to simplify control of punching holes in a profile. A distance within the presented range allows for profiles with a dense regular or semi-regular pattern of holes.

In an embodiment a selection of punches by the selection control remains unchanged while a punch of the punch unit is in contact with the profile. After selecting a punch by the selection control, the punch is locked to the first die shoe. If the selection of punches changes during punching a hole, the selected punch is not further displaced by the first die shoe and is for instance retracted in the first die shoe. This could result in a deformation of the profile at the position of the punch instead of a punched hole. Consequently it is beneficial that the selection of punches remains stationary during punching. Preferably the selection of punches is done during regular intervals. This is advantageous for easy predictable timing for punching holes in the profile.

In an embodiment the method comprises the additional step of measuring a position of a longitudinal edge of the profile relative to an axis in the first direction after displacing the profile in the first direction. The axis is preferably a reference axis throughout the punch unit for measuring displacements in a direction perpendicular to the first direction. The axis lies for instance in a support structure as described in a previous embodiment. This step is advantageous for punching holes accurately in a profile with camber or bow. When having camber or bow, the holes would be very accurately positioned in the first direction, but not in a direction transverse to the first direction. Because the displacement of the profile in said direction transverse to the first direction is measured, corrective actions can be taken and an accurate position of holes in said direction transverse to the first direction can be obtained.

For instance, in case of a U-profile, whereby the web of the U-profile is in a horizontal plane and the first direction is within said horizontal plane, holes in the web of the U-profile would not be accurately positioned in a horizontal direction perpendicular on the first direction when having camber. The position of a longitudinal edge, being one of both flanges in case of punching holes in the web or, is measured relative to a horizontal axis, parallel to the first direction.

In a further embodiment the method comprises the additional step of adjusting the position of the profile in a direction transverse to the first direction after measuring said position of said longitudinal edge of the profile relative to said axis in the first direction. This is advantageous when punching holes in a profile with camber or bow. The adjustment of the position of the profile will result in accurate positioning of the holes in a direction transverse to the first direction.

For instance in the case of a U-profile with camber, whereby the web of the U-profile is in a horizontal plane and the first direction is within said horizontal plane, the position of the profile will be adjusted in a direction in the horizontal plane and perpendicular to the first direction, compensating for a difference in measured position of the longitudinal edge of the profile, being one of both flanges, relative to said axis in the first direction and an expected position of said longitudinal edge, at a position in the first direction where the holes have to be punched in the web.

In a further embodiment the method comprises the additional step of verifying said position of said longitudinal edge of the profile relative to said axis in the first direction after adjusting the position of the profile. This is beneficial because the displacement of the profile can cause vibrations or because during the displacement the profile could hit the punch unit, resulting in a displacement of the profile and an incorrect positioning of the holes in a direction transverse the first direction.

In an embodiment the holes are punched in the profile by the punch unit at a constant speed. The punch unit has a constant speed of at least 90 strokes per minute, preferably at least 100 strokes per minute, more preferably at least 110 strokes per minute and even more preferably 115 strokes per minute. The punch unit has a constant speed of at most 210 strokes per minute, preferably at most 200 strokes per minute, more preferably at most 190 strokes per minute and even more preferably at most 185 strokes per minute. Within this range it is possible to punch at a fast pace holes in a profile. For instance at 180 strokes per minute and when punching 5 holes simultaneously, 900 holes per minute can be punched in a profile. A constant speed is also advantageous for having a predictable timing for displacing a profile in the first direction.

In a further embodiment zero punches are selected during a stroke. This is especially advantageous in a section of the profile wherein no holes have to be punched and in combination with a previously described embodiment wherein the profile is displaced at regular intervals over a constant distance. The punch unit can continue running at the same pace and the clamp can continue displacing the profile at the same intervals over the same constant distance without any holes being punched in said section. This simplifies tremendously the control of the punch unit. This is additionally beneficial in combination with a punch unit comprising a transmission shaft. A transmission shaft of a punch unit is a heavy object and requires a lot of energy to start and stop rotating. With the current embodiment, the transmission shaft can continue running.

In an embodiment at least two holes are punched simultaneously, on a line perpendicular to the first direction. This is advantageous for punching holes in profiles wherein a profile comprises parallel tracks of holes in the first direction and wherein the holes on the different parallel tracks are positioned at a same position in the first direction. Five parallel tracks are sufficient for most common profiles with regular and semi-regular hole patterns.

In an embodiment a second clamp slideable in the first direction, removes the profile out of the punch unit. The first and second die shoe of the punch unit are positioned in between the clamp and said second clamp according to the first direction. Support structures of the clamp and the second clamp are aligned along their longitudinal axes in the first direction. The current embodiment is advantageous for creating a continuous method, wherein profiles are fed by the clamp and removed by the second clamp. The embodiment is also advantageous when it is required to punch holes over substantially the whole length of the profile. In that case it is not possible to clamp the profile with the first clamp on a position not requiring punching holes. By taking over the profile with the second clamp, the clamp can be released and holes can be punched in the profile on the position previously covered by the clamp.

In a further embodiment, the clamp and the second clamp are stationary during take-over of the profile by the second clamp. This is beneficial to avoid that the profile hits one of the clamps during take-over or that the profile slips in one of the clamps. This could result in inaccurate positions in the first direction of the remaining holes. Preferably zero punches are selected during take-over. This has similar advantageous as described in a previous embodiment about section in the profile without holes to be punched.

In a third aspect, the invention relates to use of a punch unit according to the first aspect or a method according to the second aspect for punching holes in web and flanges of a U-profile for a truck or trailer chassis.

This use provides an advantageous effect that holes can be punched with a high throughput in the web of a U-profile of a truck or trailer chassis. This is important as the web of U-profiles of a truck or trailer chassis can easily comprise 150 up to 900 holes. The use is particular advantageous in the case the holes in the web have to be punched in a regular or semi-regular pattern with a fixed distance in the first direction between the holes.

The use of a system according to the first aspect or a method according to the second aspect allows processing U-profiles for truck or trailers with a length of at least 4 m up to 12 m. The system allows use of a U-profile which can have a camber of at least 1 mm per 1000 mm of length with a maximum aggregated camber of 5 mm on a total length of 12 000 mm, preferably a maximum aggregated camber of 6 mm, more preferably a maximum aggregated camber of 7 mm and even more preferably a maximum aggregated camber of 8 mm. With a punch unit according to the first aspect of the invention or a method according to the second aspect of the current invention it is possible to punch 900 holes per minute when five holes can be punched simultaneously at a constant speed of 180 strokes per minute.

It is clear that the method according to the invention, and its applications, are not limited to the presented examples.

It is clear for a person of ordinary skill in the art that a system according to the first aspect is preferably configured for executing a method according to the second aspect and that a method according to the second aspect can be executed using a system according to the first aspect. Every characteristic, described in this document, above as below, can be applicable to each of the three aspects of the current invention.

The invention is further described by the following non-limiting figures which further illustrate the invention, and is not intended to, nor should it be interpreted to, limit the scope of the invention.

DESCRIPTION OF FIGURES

FIG. 1 shows a schematic overview of a punch unit according to an embodiment of the present invention.

Figure 1B:
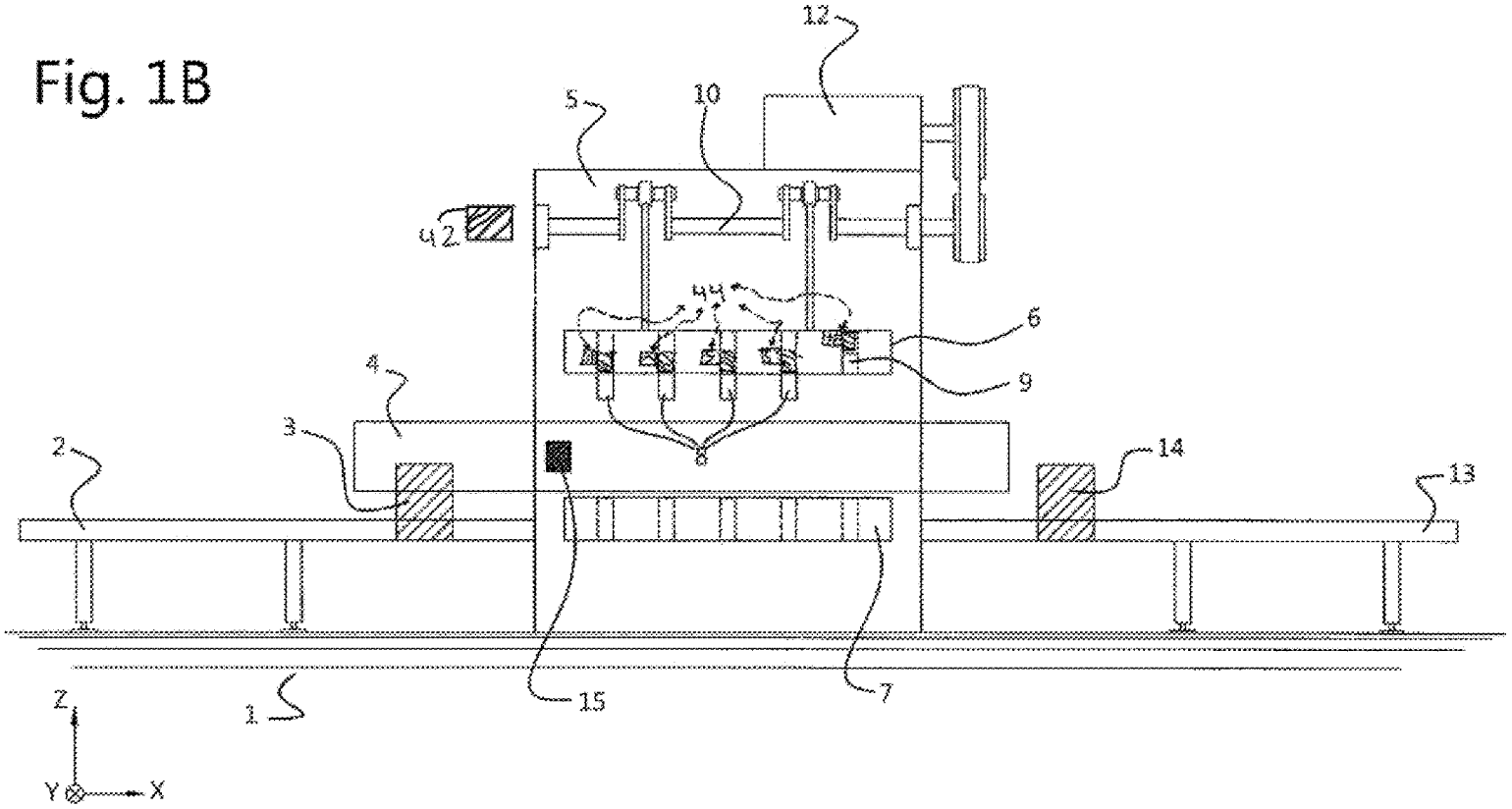

The punch unit depicted in FIGS. 1A and 1B is suitable for punching holes in the web of U-profiles for trucks or trailers. The holes are in a regular or semi-regular pattern. The punch unit is placed on a floor surface (1). The punch unit comprises a clamp (3). The clamp (3) is positioned on a support structure (2). The support structure (2) extends along a first direction, corresponding to the direction of the X-axis. Profile (4) extends in a longitudinal direction. The profile (4) is a U-profile. The profile (4) is processed in the punch unit, whereby the longitudinal direction of the profile (4) is parallel with the X-axis. The clamp (3) is slideable along the direction of the X-axis. The clamp (3) is configured to displace the profile (4) in a punch unit (5) in the direction of the X-axis. Punch unit (5) is configured for punching holes in the web of the profile (4). The punch unit (5) comprises a first die shoe (6) and a second die shoe (7). In this case the first die shoe (6) is also called the upper die shoe and the second die shoe (7) is called the lower die shoe. The first die shoe (6) comprises punches (8) and (9). The second die shoe (7) comprises complementary holes to receive the punches (8) and (9) comprised in the first die shoe (6).

Figure 4:
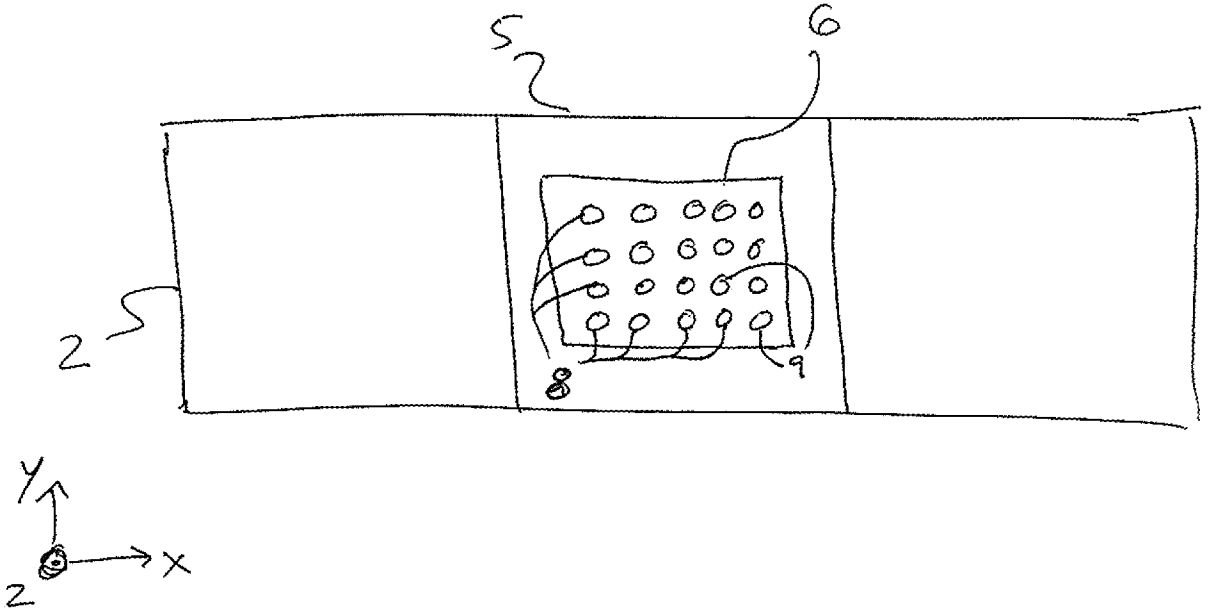
FIG. 4 shows a top partial schematic view of a punch unit according to FIG. 1A and FIG. 1B.

The punch unit (5) comprises a selection control (42) to select punches (8) to punch holes in the web of profile (4). A non-selected punch (9) is in FIGS. 1A and 1B retracted in the first die shoe (6). It is clear that the depicted arrangement of punches (8) and (9) in FIGS. 1A and 1B is purely illustrative. Depending on the needs more or less punches (8) and (9) can be comprised in the first die shoe (6). As shown in FIG. 4, punches (8) and (9) can also be arranged in a direction parallel to the Y-axis. Selected punches (8) extend from the first die shoe (6). The punch unit (5) comprises a transmission shaft (10), configured for translating a rotational movement of a motor (12) to a linear movement and configured for displacing the first die shoe (6) in a stroke direction, transverse to the first direction over a stroke length. In FIG. 1A, the transmission shaft (10) is a camshaft, and the first die shoe (6) is displaced by pointed cams (11) of the camshaft. In FIG. 1B, the transmission shaft (10) is a crankshaft. The stroke direction is parallel with the Z-axis. The first die shoe (6) is displaced by the transmission shaft (10) from a first position at a distance from the second die shoe (7) to a second position wherein the selected punches (8) enter at least partly in complementary holes of the second die shoe (7). Selected punches (8) punch simultaneously holes in the web of profile (4). When exiting the punch unit (5), the profile (4) is taken over by a second clamp (14) of the punch unit (5). Clamp (14) is positioned on a support structure (13). The support structure (13) extends along a first direction, corresponding to the direction of the X-axis. Support structures (2) and (13) are aligned in the first direction. The clamp (14) clamps the profile (4) while the clamp (3) is still clamping profile (4) and while clamp (3) is stationary. Clamp (14) is at that moment also stationary. Clamp (3) releases profile (4) when clamp (14) has successfully clamped profile (4). Clamp (14) displaces profile (4) out of punch unit (5). The punch unit (5) comprises a displacement sensor (15). For compensating for camber of profile (4), punch unit (5) comprises one or more displacement sensors (15), comprising two measuring wheels, coupled to linear encoders. The two measuring wheels are positioned at opposite sides of a passage (40, as shown in FIG. 1A) for the profile (4) in punch unit (5). The measuring wheels of the displacement sensor (5) are pushed against flanges of profile (4). The displacement of the measuring wheels are measured with the linear encoders coupled with the measuring wheels. The measurements are corresponding to a displacement of profile (4) in the direction of the Y-axis relative to an axis parallel with the X-axis due to camber. Said axis is preferably positioned in the support structure (2).

Figure 2:
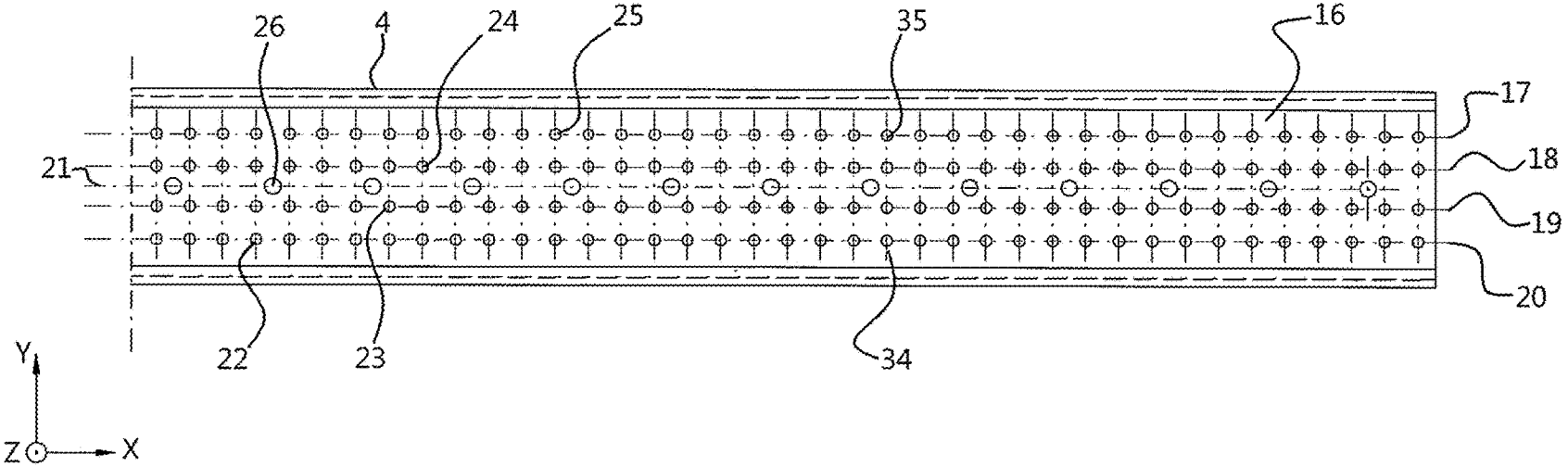
FIG. 2 shows an example of a semi-regular pattern of holes in a profile.

FIG. 2 shows an example of a semi-regular pattern of holes in a profile.

In the web (16) of profile (4) holes are punched in a semi-regular pattern. Profile (4) is fed in the direction of the X-axis in a punch unit. The X-axis corresponds with the first direction. The holes at the right hand side of profile (4) are punched first. The holes are positioned along five parallel tracks (17), (18), (19), (20) and (21). The five parallel tracks (17), (18), (19), (20) and (21) extend in the direction of the X-axis. The holes on each of the four parallel tracks (17), (18), (19) and (20) have a constant distance of 50 mm between them in the direction of the X-axis. Holes on the track (21) have a constant distance of 150 mm between them. The holes on the track (21) have an offset in the first direction of 25 mm compared to the holes of the four parallel tracks (17), (18), (19) and (20). All holes on track (18) are holes (24). All holes on track (19) are holes (23). All holes on track (17) are holes (25), with exception of a single hole (35). All holes on track (20) are holes (23), with exception of a single hole (34). Holes (22) on track (20), holes (23) on track (19), holes (24) on track (18) and holes (25) on track (17) have a diameter of 17.5 mm. Holes (26) on track (21) have a diameter of 25 mm. The pattern of the holes is a semi-regular pattern because the distance in the first direction between the holes changes between 50 mm and 25 mm. The pattern of the holes is also a semi-regular pattern because hole (34) in track (20) and hole (35) in track (21) have a diameter of 16.5 mm.

Figure 3:
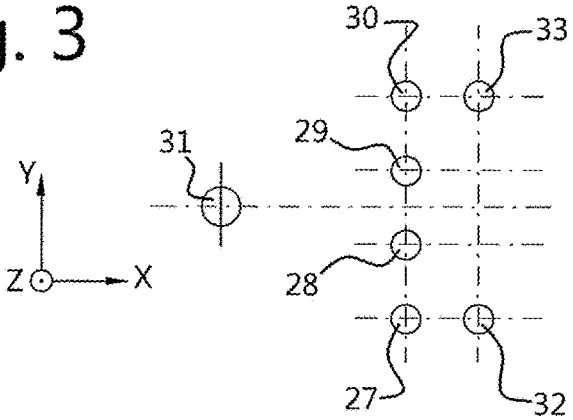
FIG. 3 shows a schematic representation of the position of punches for obtaining a semi-regular pattern of holes as depicted in FIG. 2.

FIG. 3 shows a schematic representation of the position of punches for obtaining a semi-regular pattern of holes as depicted in FIG. 2.

Punches are distributed in three groups of punches. A first group comprises two punches (32) and (33) on a line parallel with the Y-axis. This is perpendicular to both the first direction (X-axis) and the stroke direction (Z-axis). The punches (32) and (33) have a diameter of 16.5 mm. A second group comprises four punches (27), (28), (29) and (30) on a line parallel with the Y-axis. The four punches (27), (28), (29) and (30) have a diameter of 17.5 mm. The second group is positioned at a distance of 50 mm to the left from the first group in the direction of the X-axis. The third group comprises one punch (31) with a diameter of 25 mm. The third group is positioned at a distance of 125 mm to the left from the second group in the direction of the X-axis. The position of the punches (27), (28), (29), (30), (31), (32) and (33) correspond to the position of the tracks (17), (18), (19), (20) and (21) in the web of profile (4) in FIG. 2.

During a first stroke, only punch (31) is selected and a first hole (25) on track (21), starting from the right hand side of the profile (4) in FIG. 2, with a diameter of 25 mm is punched. Before the next holes are punched, the profile (4) is displaced 50 mm to the right in the direction of the X-axis. The punches (27), (28), (29) and (30) are selected. During the second stroke, hole (22) in track (20), hole (23) in track (19), hole (24) in track (18) and hole (25) in track (17) are simultaneously punched. These are the first holes on these tracks in the direction of the X-axis starting from the right hand side. This is repeated during the third stroke. During the fourth stroke punch (31) is additionally selected and a third hole (22) in track (20), a third hole (23) in track (19), a third hole (24) in track (18), a third hole (25) in track (17) and a second hole (26) in track (21) are punched in the profile (4). During the fifth stroke punch (31) is deselected and a fourth hole (22) in track (20), a fourth hole (23) in track (19), a fourth hole (24) in track (18) and a fourth hole (25) in track (17) are punched in the profile (4). So punch (31) is selected the next time during stroke 7, 10, 13, . . . and deselected during stroke 8, 11, 14, . . . . During stroke 18 punches (27) and (30) are deselected. A seventeenth hole (23) in track (19) and a seventeenth hole (24) in track (18) are punched. The positions for the holes (34) and (35) with a deviating diameter of 16.5 mm remain during stroke 18 moment untouched. During stroke 19 punches (27) and (30) are selected again, as well as the punches (33) and (32). Six holes are punched simultaneously, a seventeenth hole (22) in track (20), a eighteenth hole (23) in track (19), a eighteenth hole (24) in track (18), a seventeenth hole (25) in track (17) and the holes (34) and (35) with the deviating diameter of 16.5 mm. This example clarifies that with a punch unit and/or method according to the current invention it is possible to obtain within a short period a profile with a dense regular or semi-regular pattern of holes.

It is for a person of ordinary skill in the art clear that other regular or semi-regular patterns can be obtained by selecting or deselecting the punches in other sequences or using a first and second die shoe with another arrangement of punches.

The invention claimed is:

1. A punch unit system, comprising:

a punch unit for punching holes in a profile with high-throughput comprising:

a first clamp, slideable in a first direction;

a first die shoe, comprising at least two punches in a retracted position therein;

a second die shoe comprising holes complementary to the at least two punches;

a passage for a profile between the at least two punches of the first die shoe and the second die shoe;

a transmission shaft, configured for translating a rotational movement to a linear movement and configured for displacing said first die shoe in a stroke direction, transverse to said first direction, during each rotational movement; and a selection control configured for, prior to each said displacement of the first die shoe, selecting a punch from the at least two punches for each hole to be punched in the profile positioned in the passage, and a locking mechanism configured for locking each selected punch in an extended position on the first die shoe, such that, during each said displacement of the first die shoe, each selected and locked punch is positioned at least partially within the holes of the second die shoe, thereby punching said hole to be punched in the profile, wherein the punch unit comprises a displacement sensor, configured for measuring displacement of the profile in a direction transverse to the first direction, relative to an axis in the first direction.

2. The punch unit system according to claim 1, wherein at least two of the at least two punches are positioned in the first die shoe on a line perpendicular to both the first direction and the stroke direction.

3. The punch unit system according to claim 1, wherein an installed set comprising the installed first die shoe, comprising the at least two punches, and the corresponding installed second die shoe is replaceable with a different set comprising a different first die shoe and a different corresponding second die shoe, wherein the installed first die shoe comprises a different set of the at least two punches than the different first die shoe, wherein, when the punch unit comprises the installed set of the installed first and second die shoes, the punch unit is configured to produce a different set of regular or semi-regular hole patterns, as compared to when the punch unit comprises the different set of the different first and second die shoes.

4. The punch unit system according to claim 1, wherein the transmission shaft is configured to rotate at constant speed.

5. The punch unit system according to claim 1, wherein the clamp is configured to displace the profile during regular intervals.

6. The punch unit system according to claim 1, wherein the punch unit further comprises a second clamp, slideable in the first direction, and wherein the first and second die shoes are positioned in between said first clamp and said second clamp according to the first direction.

7. A method for punching of holes in a profile with high-throughput comprising: clamping the profile in a clamp of a punch unit, wherein the punch unit further comprises:

a first die shoe comprising at least two punches in a retracted position therein;

a second die shoe comprising complementary holes to the at least two punches;

a passage for the profile between the at least two punches of the first die shoe and the second die shoe; and a transmission shaft, configured for translating a rotational movement to a linear movement and configured for displacing the first die shoe in a stroke direction, transverse to the first direction;

displacing the profile in the passage of the punch unit by sliding the clamp in a first direction;

selecting at least one punch from the at least two punches of the punch unit using a selection control, a locking mechanism, configured for, prior to said displacement of the first die shoe, locking each selected punch in an extended position on the first die shoe; and punching at least one hole in the profile by the punch unit;

wherein, during said displacement of the first die shoe, each selected and locked punch is positioned at least partially within the complementary hole in the second die shoe, thereby punching said at least one hole in the profile, wherein the method further comprises measuring a position of a longitudinal edge of the profile in a direction transverse to the first direction, relative to an axis in the first direction, after displacing the profile in the first direction using a displacement sensor.

8. The method according to claim 7, wherein the clamp remains at least stationary while a punch of the punch unit is in contact with the profile.

9. The method according to claim 7, wherein the method further comprises adjusting the position of the profile in the direction transverse to the first direction after measuring said position of said longitudinal edge of the profile relative to said axis in the first direction.

10. The method according to claim 7, wherein the least one hole punched in the profile comprises at least two holes punched simultaneously, on a line perpendicular to the first direction.

11. The method according to claim 7, wherein the profile is a U-profile for a truck or trailer chassis, and wherein punching said at least one hole in the profile by the punch unit comprises punching at least one hole in a web and/or one or more flanges of the U-profile.

* * * * *